US010501239B2

(12) United States Patent
Dagnelie et al.

(10) Patent No.: US 10,501,239 B2
(45) Date of Patent: Dec. 10, 2019

(54) CONTAINER SYSTEMS

(71) Applicant: The Procter & Gamble Company, Cincinnati, OH (US)

(72) Inventors: Thierry Christian Francis Dagnelie, Waterloo (BE); Vincent Hubert M. De Wilde, Kessel-Lo (BE); Nicolas Robert Nuno Cromarty Oliveira, Ferrieres (BE); Raf Gustaaf Alfons Degeyter, Herk-de-Stad (BE); David Brian Dawson, Greensboro, NC (US)

(73) Assignee: The Procter & Gamble Company, Cincinnati, OH (US)

( * ) Notice: Subject to any disclaimer, the term of this patent is extended or adjusted under 35 U.S.C. 154(b) by 61 days.

(21) Appl. No.: 15/807,609

(22) Filed: Nov. 9, 2017

(65) Prior Publication Data

US 2018/0134467 A1 May 17, 2018

Related U.S. Application Data

(60) Provisional application No. 62/420,616, filed on Nov. 11, 2016.

(51) Int. Cl.

| | |
|---|---|
| ***B65D 43/22*** | (2006.01) |
| ***B65B 7/28*** | (2006.01) |
| ***B65D 43/16*** | (2006.01) |
| ***B65D 43/26*** | (2006.01) |
| ***B65D 45/18*** | (2006.01) |
| ***B65D 43/02*** | (2006.01) |
| *C11D 17/04* | (2006.01) |

(52) U.S. Cl.

CPC ..... *B65D 43/22* (2013.01); *B65B 7/2842* (2013.01); *B65D 43/0202* (2013.01); *B65D 43/163* (2013.01); *B65D 43/169* (2013.01); *B65D 43/26* (2013.01); *B65D 45/18* (2013.01); *B65D 2215/02* (2013.01); *B65D 2251/1041* (2013.01); *B65D 2543/0049* (2013.01); *B65D 2543/00194* (2013.01); *B65D 2543/00435* (2013.01); *C11D 17/042* (2013.01)

(58) Field of Classification Search

CPC ..... B65D 45/327; B65D 43/022; B65D 21/0219; B65D 43/163; B65D 51/18

USPC ..... 220/281

See application file for complete search history.

(56) References Cited

U.S. PATENT DOCUMENTS

| | | | |
|---|---|---|---|
| 5,671,853 | A | 9/1997 | Herr |
| 5,836,465 | A | 11/1998 | King |
| 6,092,690 | A | 7/2000 | Bitowft |
| 6,371,316 | B1 | 4/2002 | Herr et al. |

(Continued)

FOREIGN PATENT DOCUMENTS

| | | |
|---|---|---|
| CN | 202358450 U | 8/2012 |
| CN | 303188596 | 4/2015 |

(Continued)

OTHER PUBLICATIONS

Search Report for PCT app. No. PCT/uS2017/060994, dated Mar. 21, 2018, 86 pages.

(Continued)

*Primary Examiner* — Shawn M Braden
(74) *Attorney, Agent, or Firm* — Gregory S. Darley-Emerson

(57) ABSTRACT

Container systems. Methods related to container systems.

18 Claims, 10 Drawing Sheets

(56) References Cited

U.S. PATENT DOCUMENTS

| | | | | |
|---|---|---|---|---|
| 6,499,626 | B1 | 12/2002 | Julius | |
| 6,655,544 | B1 | 12/2003 | Tanaka et al. | |
| 6,951,292 | B2 | 10/2005 | Bando et al. | |
| 6,986,434 | B1 | 1/2006 | Getsy et al. | |
| 7,073,679 | B1 | 7/2006 | Lagler et al. | |
| 7,290,673 | B2 | 11/2007 | Hagano | |
| 7,753,228 | B2 | 7/2010 | Yuhara | |
| 7,988,014 | B2 | 8/2011 | Jan et al. | |
| D653,105 | S | 1/2012 | Degeyter et al. | |
| 8,360,257 | B2 | 1/2013 | Sebille et al. | |
| 8,371,463 | B2 | 2/2013 | Beecroft | |
| 8,540,116 | B2 | 9/2013 | Giraud et al. | |
| 8,720,740 | B2 | 5/2014 | Bratsch | |
| 8,973,242 | B2 | 3/2015 | Damaghi et al. | |
| 9,150,340 | B2 | 10/2015 | Pawlik | |
| 9,718,589 | B2 | 8/2017 | Kopulos et al. | |
| 2008/0041869 | A1* | 2/2008 | Backaert | B65D 39/025 220/804 |
| 2009/0020493 | A1 | 1/2009 | Yeager | |
| 2011/0309098 | A1 | 12/2011 | Hayashi et al. | |
| 2012/0325691 | A1 | 12/2012 | Wang | |
| 2013/0037540 | A1* | 2/2013 | Sze | B65D 43/022 220/237 |
| 2014/0151388 | A1 | 6/2014 | Culeron et al. | |
| 2014/0284333 | A1 | 9/2014 | Poon et al. | |
| 2014/0305819 | A1 | 10/2014 | Hill et al. | |
| 2016/0000245 | A1 | 1/2016 | Sims | |
| 2016/0229599 | A1 | 8/2016 | Rogers et al. | |
| 2017/0349341 | A1 | 12/2017 | Girardot et al. | |

FOREIGN PATENT DOCUMENTS

| | | | |
|---|---|---|---|
| DE | 202014010527 | U1 | 12/2015 |
| EA | EP2628688 | A1 | 8/2013 |
| EM | EU000091103-0001 | | 2/2004 |
| EM | EU000091103-0002 | | 2/2004 |
| EM | EU000101829-0002 | | 2/2004 |
| EM | EU000101829-0005 | | 2/2004 |
| EM | E000810841-0001 | U | 11/2007 |
| EM | EU000799788-0002 | | 6/2009 |
| EM | EU002693002-0001 | | 5/2015 |
| EM | EU002693002-0002 | | 5/2015 |
| EM | EU002693002-0003 | | 5/2015 |
| EM | EU002693002-0004 | | 5/2015 |
| EM | EU002289256-0001 | | 8/2015 |
| FR | 2719558A1 | A1 | 11/1995 |
| JP | H09315453 | A | 12/1997 |
| JP | 2001048210 | A | 2/2001 |
| JP | 2003170950 | A | 6/2003 |
| JP | D1409814 | | 3/2011 |
| WO | WO9748615 | A1 | 12/1997 |
| WO | WO2007110106 | A1 | 10/2007 |

OTHER PUBLICATIONS

PCT Search Report for appl. No. PCT/US2017/060976, dated Feb. 21, 2019, 6 pgs.

PCT Search Report for appl. No. PCT/US2017/060985, dated Jan. 23, 2018, 9 pgs.

All Office Actions for U.S Appl. No. 15/807,608.

All Office Actions for U.S. Appl. No. 15/807,610.

All Office Actions for U.S. Appl. No. 15/807,607.

U.S. Appl. No. 15/807,607, filed Nov. 9, 2017, Thierry Christian Francis Dagnelie.

U.S. Appl. No. 15/807,608, filed Nov. 9, 2017, Nicolas Robert Nuno Cromarty Oliveira.

U.S. Appl. No. 15/807,610, filed Nov. 9, 2017, Vincent Hubert M. De Wilde.

* cited by examiner

CONTAINER SYSTEMS

FIELD OF THE INVENTION

The present disclosure relates to container systems and methods related to such container systems.

BACKGROUND OF THE INVENTION

Container systems commonly include a container body and a closure system, such as a lid. The closure systems may further include locking systems to prevent access by unintended users, such as children, to the contents stored in the containers.

Even when the locking systems themselves are effective in deterring access, however, the container systems may sometimes still be opened by determined individuals. For example, the lids and/or closure systems may be pried off altogether by pulling up at an outer edge of the lid and/or closure system, particularly when the closure system snaps onto the container body and is not secured, e.g., by threads.

There is a need for improved, secure container systems.

SUMMARY OF THE INVENTION

The present disclosure relates to container systems and related methods.

For example, the present disclosure relates to a container system that includes a container body having a storage space and an opening that provides access to the storage space, the container body further having a rim that substantially encircles the opening, the rim having an upper surface. The container system further includes a closure system that is connectable to the container body and is sized and configured to cover the opening when the closure system is in a closed position, preventing access to the storage space. The closure system includes a locking system, where when the locking system is engaged, the closure system is retained in the closed position, and when the locking system is not engaged, the closure system can be moved from the closed position to an open position. When the closure system is connected to the container body and is in the closed position, the closure system does not cover the upper surface of the rim.

The present disclosure also relates to a method of assembling a container system. The method includes the step of providing a container body as described herein, providing a closure system as described herein, and connecting the closure system and the container body so that when the closure system is in the closed position, the closure system does not cover the upper surface of the rim.

The present disclosure further relates to a container system that includes a container body and a closure system that is connectable to the container body, the container body having a storage space, an opening that provides access to the storage space, and a neck that substantially encircles the opening; the closure system being sized and configured to the cover the opening when the closure system is in a closed position, thereby preventing access to the storage space, the closure system further including a locking system, where when the locking system is engaged, the closure system is retained in the closed position, and where when the locking system is not engaged, the closure system can be moved from the closed position to an open position, where when the closure system is in the closed position, an outer or terminal edge of the closure system that is spaced away from the center of the closure system is nested in the neck of the container body; the container system further comprising unitized dose articles in the storage space.

BRIEF DESCRIPTION OF THE DRAWINGS

The figures herein are illustrative in nature and are not intended to be limiting.

DETAILED DESCRIPTION OF THE INVENTION

Figure 1:
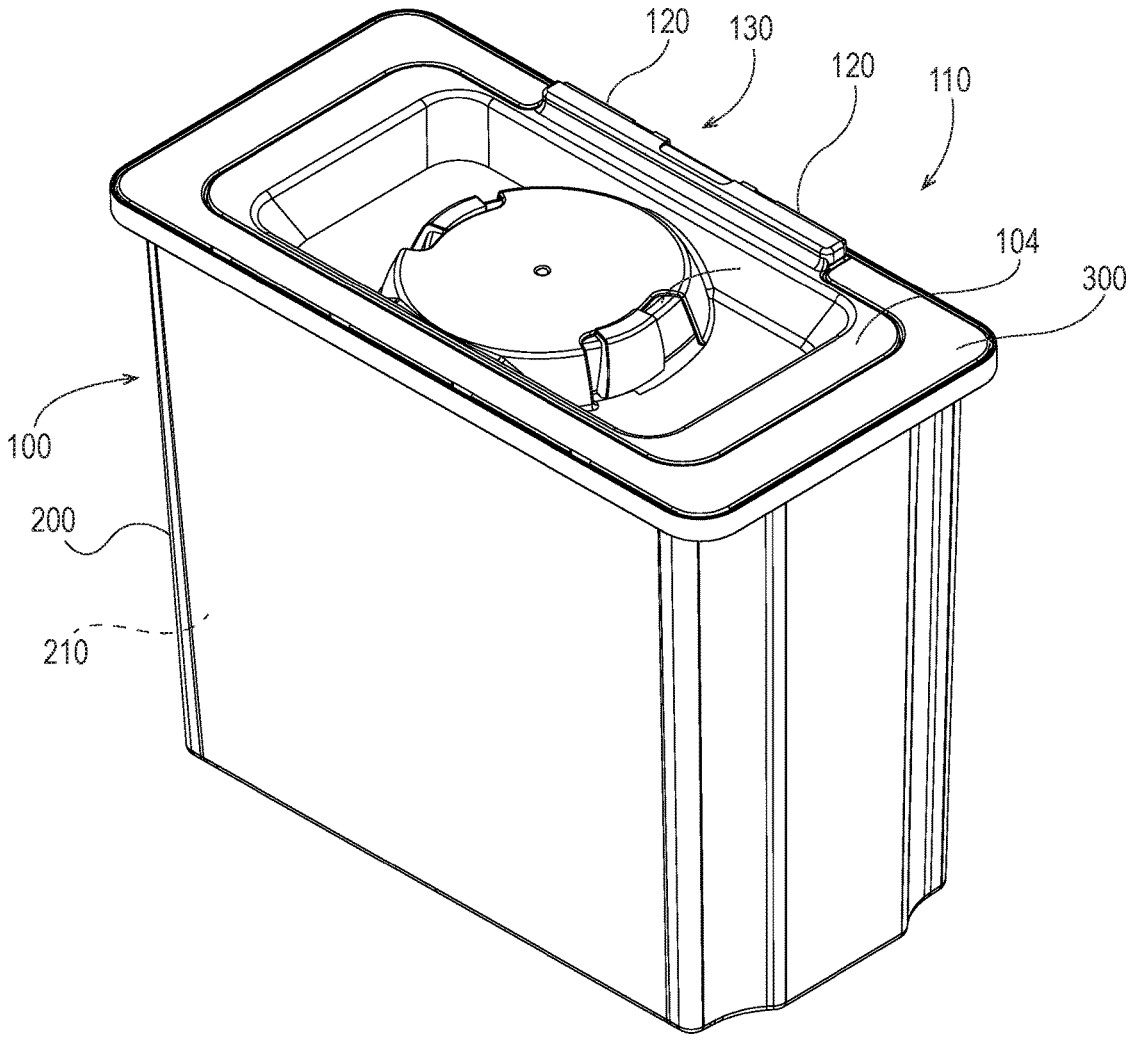
FIG. 1 shows a top perspective view of a container system according to the present disclosure.

The present disclosure relates to container systems that include a container body and a closure system that includes a locking system. The closure system is inset relative to (or nests within) the rim of the container body. In such a configuration, a terminal edge of the closure system is effectively hidden and cannot easily be accessed. Therefore, the lid cannot be easily pried off, and the security of the container system is improved.

Furthermore, the locking system may be relatively inward to the rim and/or exterior surface of the walls of the container. In this configuration, the locking system is less likely to be disengaged in accidental or unintended circumstances, for example by bumping during transport, or used as a leverage point to pry the closure system from the container body.

The present container systems also benefit from additional "billboard" space on the walls of the container, as the entire wall can be used for commercial, safety, or instructional messaging as seen by a consumer, e.g., when the container system is placed on a store shelf. Compare this to previous containers, where the closure system is not inset compared to the rim or neck of the container body and hung over the upper portion of the container body, minimizing the space usable for messaging. The container system also benefits from improved aesthetics, as a smooth, coherent look to the system is achieved.

The container systems of the present disclosure and methods related thereto are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Container Systems

The present disclosure relates to container systems. FIG. 1 shows an illustrative container system 100 according to the present disclosure. The container system 100 includes a container body 200 and a closure system 110. The container body 200 includes a storage space 210. The closure system 110 is in a closed position, thereby preventing access to the storage space 210.

Figure 2:
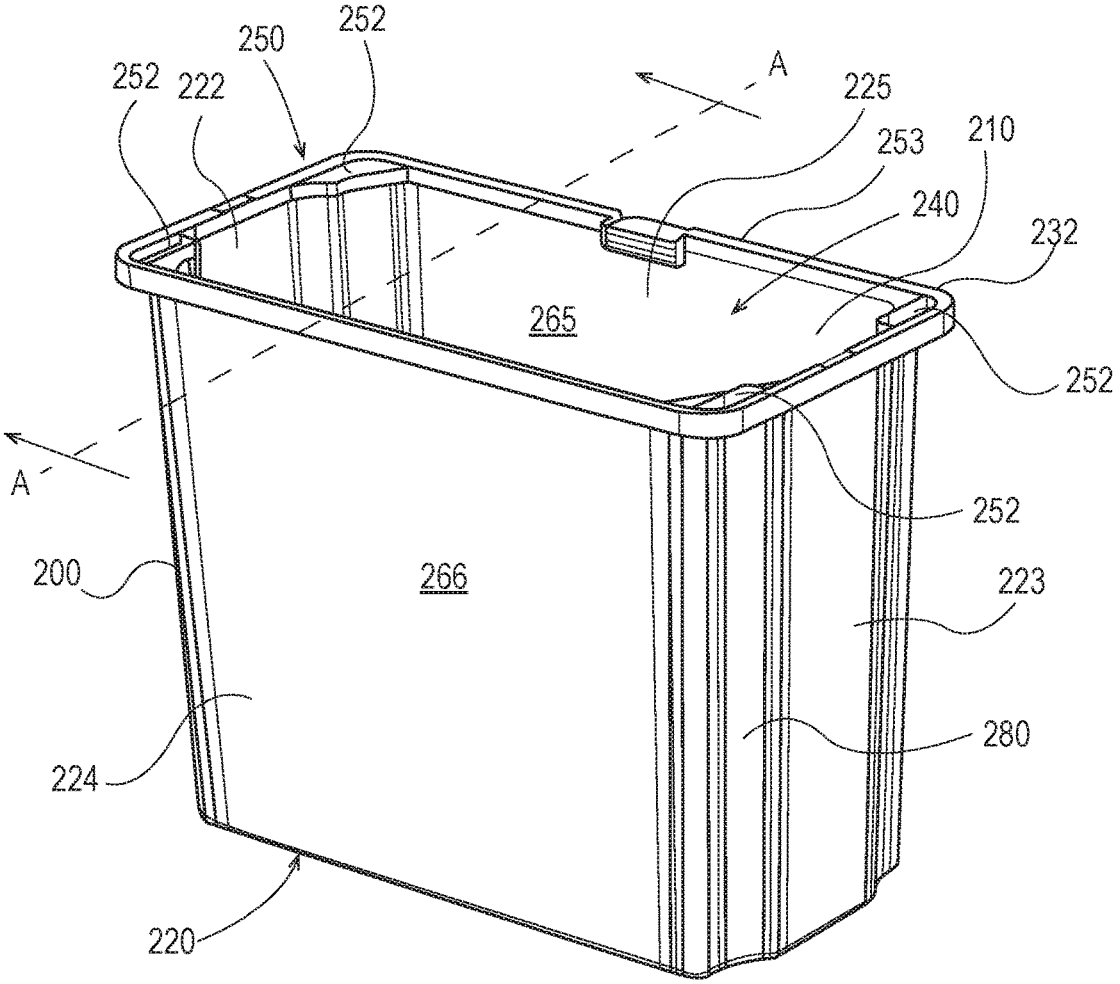
FIG. 2 shows a top perspective view of a container body according to the present disclosure.

FIG. 2 shows a container body 200. The container body 200 has a storage space 210 and an opening 240 that provides access to the storage space 210. The storage space 210 may have any suitable volume, for example, from about 300 mL, or from about 500 mL or from about 750 mL, or from about 1 L, to about 5 L, or to about 4 L, or to about 3 L, or to about 2 L, or to about 1.5 L.

The opening 240 may have any suitable size and/or shape. Larger openings may be desirable for ease of filling the container body with contents, such as consumer products.

The container body 200 may have any suitable shape, with one or more walls that define the storage space 210. The container 200 may have front wall 224, a rear wall 225, side walls 222, 223, and a bottom wall 220. The walls may have an interior surface 265 that faces the storage space 210. The walls may have an exterior surface 266 that faces away from the storage space and is opposite the interior surface 265.

The container body 200 may have a rim 232 that substantially encircles the opening 240. The shape of the rim 232 typically follows the shape of the opening 240, although it may have a different shape. The rim 232 may be continuous or discontinuous around the opening of the container body 200. For example, the rim 232 may be discontinuous at certain portions in order to accommodate a hinge 120.

The container body 200 may include connecting features 250 that facilitate connection of the closure system 110 to the container body 200. The connecting structures 250 may be selected from a rib, a bead, a thread, a tab, a slot, or combinations thereof. The connecting feature 250 may be a slot 252, 253, which may be configured to receive a tab 332 located on the frame 300 or lid 104. The body 200 may comprise a plurality of connecting features 250. The plurality may include connecting features 250 having different sizes. For example, the plurality of connecting features 250 may include a plurality of slots 252, 253. The plurality of slots may include at least one major slot 252 and at least one minor slot 253, where the major slot 252 is larger than the at least one minor slot 253.

The body 200 may comprise a plurality of major slots 252, such as at least two, at least three, or at least four major slots 252. The major slots 252 may substantially be located at corners of the body 200. The body 200 may comprise a plurality of minor slots 253, such as least two, at least three, at least four, at least five, at least six, at least seven, or at least eight, or at least nine minor slots 253. Typically, the frame 300 or lid 104 will be attached more securely to the body 200 as the number of slots 252, 253 increases.

The body 200 may be connected to the frame 300 and/or lid 104 via other means, which may not include a connecting feature 250, or which may be used in combination with a connecting feature 250. For example, the body 200 may be connected to the frame 300 and/or lid 104 by welding, for example ultrasonic welding, or by an adhesive.

Figure 3:
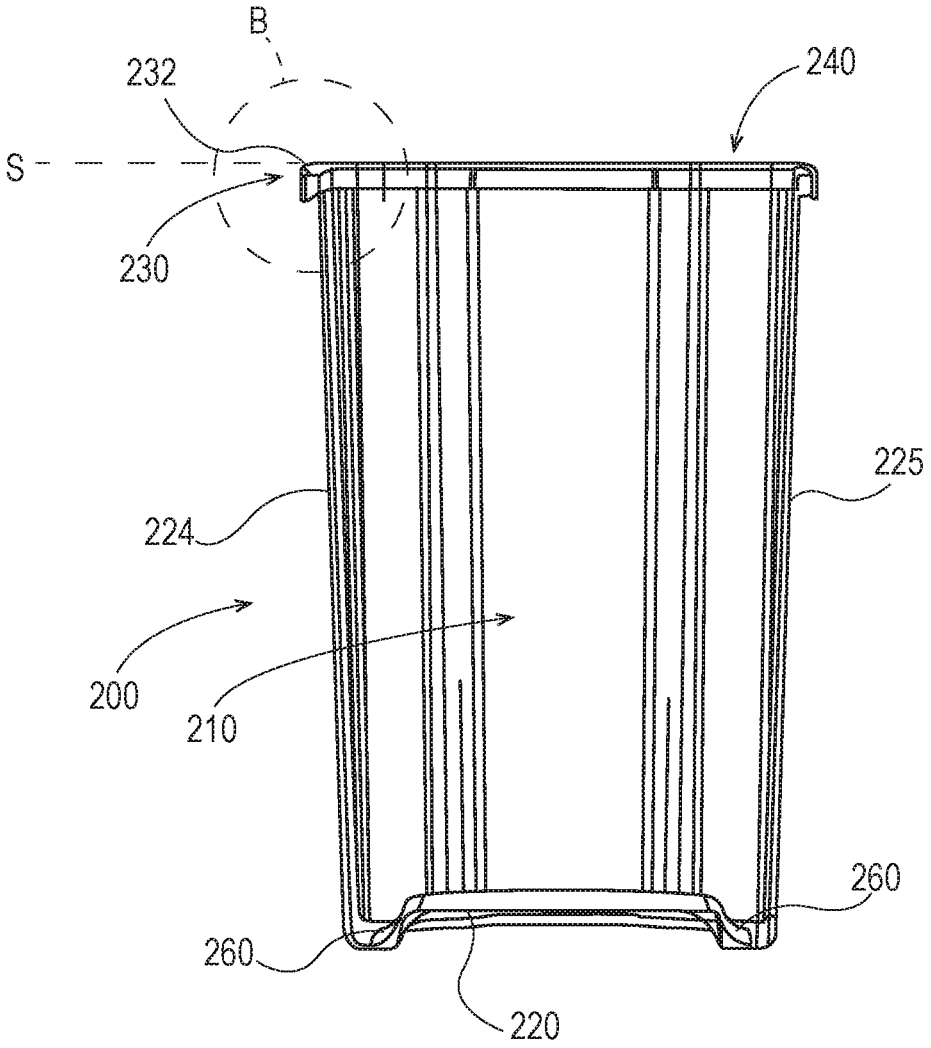
FIG. 3 shows a side cross-sectional view taken along line A-A of FIG. 2.

FIG. 3 shows a cross-sectional view of the container body 200 taken at line A-A in FIG. 2 and viewed as shown by the arrows. As can be seen in FIG. 3, the bottom wall 220 may be concave and extend towards the storage space 210 of the container body 200. The container body 200 may also include support structures 260 on the interior of the container body to provide added support and rigidity.

Figure 4:
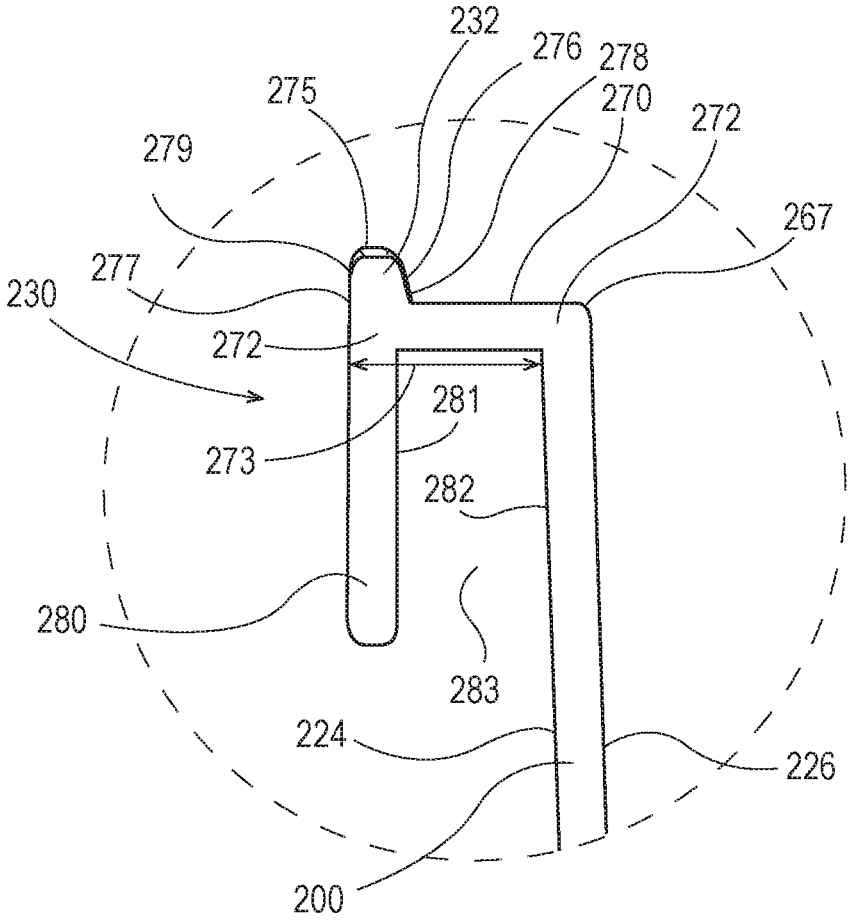
FIG. 4 shows a close-up view of the portion of FIG. 3 highlighted by circle B.

FIG. 4 shows a close-up view of the section highlighted in circle B in FIG. 3. The container body 200 may include an inner shoulder 267 at a terminal end 226 of a wall. The body 200 may include a ledge 270, where a first end 271 of the ledge 270 is connected to the terminal end 226 of the wall at the shoulder 267. The ledge 270 can act as a resting or support surface for at least a portion of the closure system 110 when the closure system 110 is connected to the body 200.

The ledge 270 may include a second end 272 that is connected to the rim 232. The ledge 270 may have a length 273 measured from the first end 271 to the second end 272. The length 273 of the ledge 270 may be consistent at various points around the container's opening 240, or it may have different lengths at different points. It may be desirable for the ledge 270 to have a greater length at the corners 280 of the container body 200 compared to portions away from the corners in order to provide a larger gripping or lifting surface to people or machine, which can be useful during filling, packaging, and/or transport processes.

The container body 200 may have a neck 230, which may comprise the terminal end 226 of one or more walls 222, 223, 224, 225, the shoulder 267, and/or the ledge 270. The neck 230 may terminate with the rim 232. The neck 230 may provide reachthrough access to the storage space 240.

As can be seen in FIG. 4, the rim 232 may have an upper surface 275. The upper surface 275 of the rim 232 may be facing upwardly, for example, in a direction that is away from the bottom wall 220 of the container body 200. The upper surface 275 of the rim 232 may be connected, preferably integrally connected, to the container body 200 at a proximal end 278 of the rim 232. The upper surface may be at a distal end 279 of the rim 232 that is opposite the proximal end 278. The rim 232 may include an inner surface 276 that faces radially inward, for example, towards the opening 240. The rim 232 may include an outer surface 277 that faces radially outward, for example, away from the opening 240.

The container body 200 may include a flange 280 that extends away from the rim 232, for example downwards towards a plane formed by the bottom wall 220 of the container body 200. The flange 280 may be continuous or discontinuous around the container body 200. An interior surface 281 of the flange 280 may face an exterior surface 282 of a wall 224. The wall 224, the ledge 270, and the flange 280 may define a space 283. The flange 280 may be useful for protecting the connecting features 250 and/or the connecting structures 330 of the container system 100, for example by covering tabs 332, 333 and prevent inwards or outwards that could lead to disengagement of the closure system 110 from the container 200. The flange 280 may also provide aesthetic benefits, for example, by covering tabs 332, 333 or support structures.

Figure 5:
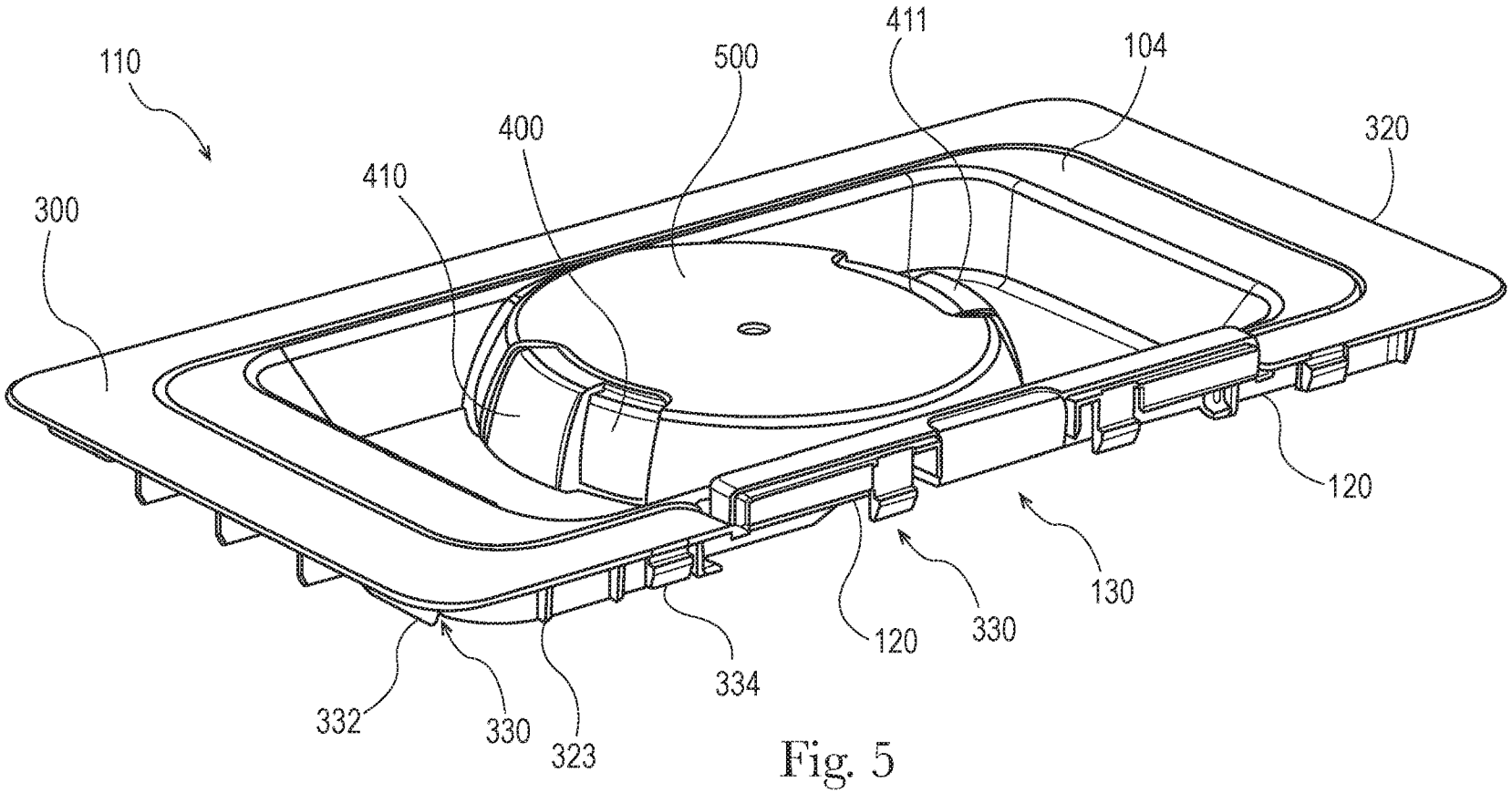
FIG. 5 shows a closure system according to the present disclosure.

FIG. 5 shows a closure system 110 according to the present disclosure. The closure system 110 may have an open position and a closed position. The closure system 110 may move about a hinge 120 when moving from the closed position to the open position. The closure system 110 may have an outer edge 320 that is radially away from the center of the closure system 110.

The closure system 110 may be connectable to the container body 200. The closure system 110 is typically sized and configured to cover the opening 240 when the closure system 110 is connected to the body 220 and in the closed position. The closure system 110 may include connecting structures 330 that are complementary to the connecting features 250 of the container body 200 in order to secure the closure system 110 to the body 200. The connecting structures 330 may be located at or near the outer periphery 320 of the frame 300. The connecting structures 330 may extend substantially axially downward towards the body 200.

The connecting structures 330 may be of any suitable configuration. The connecting structures 330 may be selected from a rib, a bead, a thread, a tab, a slot, or combinations thereof. The connecting structures 330 may be configured to be connectable to, for example receivable by, the connecting features 250 of the body 200.

The closure system 110 may be capable of being "snapped" onto the container body 200; in other words, a snap-on connection system may connect the container body and the closure system. Such snap-on connection systems may include a rib, a bead, a tab, a slot, or combinations thereof. Closures systems 110 that "snap" onto a container body (rather than screw on, or are welded on) may be particularly susceptible to being pried off and therefore may benefit from the improvements described herein.

At least some or all of the connecting structures 330 may be in the form of a tab 332, 334. The tab 332, 334 may be sized and configured to be receivable by a slot 252, 253 of the body 200. The tab 332, 334 may be made of a resilient material that can be deflected as it passes through a slot 252, 253 of the body 200 and then return to its original position, thereby locking the tab 332, 334 into place. The connecting structures 330 may comprise a major tab 332 and a minor tab 334. When the closure system 110 is connected to the container body 200, a major tab 332 may be received by a major slot 252, and/or a minor tab 334 may be received by a minor slot 253.

Figure 6:
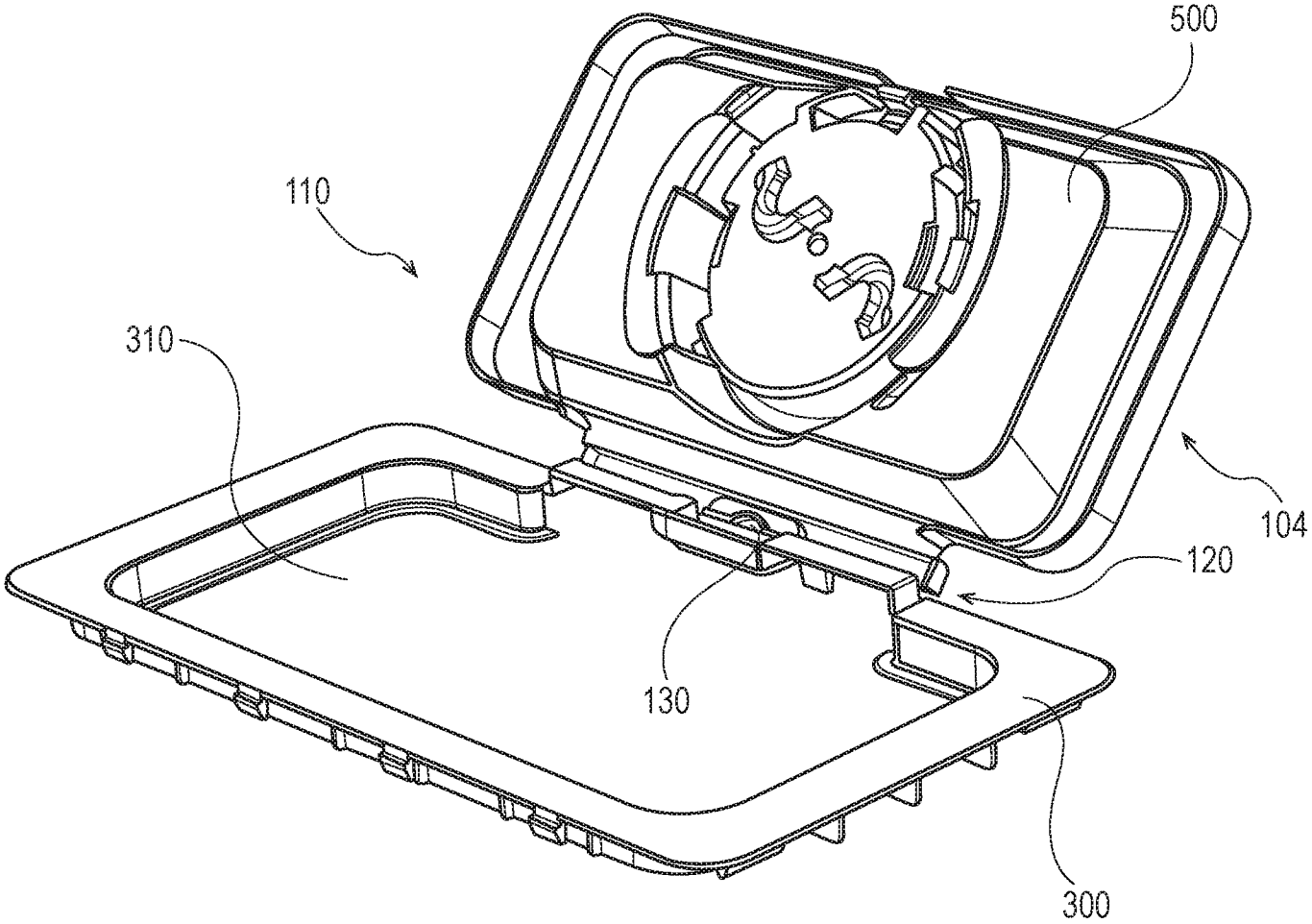
FIG. 6 shows an exploded view of a closure system according to the present disclosure.

FIG. 6 shows an exploded view of a closure system 110 according to the present disclosure, where the closure system 110 is in the open position. The closure system 110 may include a frame 300 and a lid 104. The lid 104 may be hingedly connected to the frame 300, e.g, by a hinge 120. The lid 104 may be threadedly connected to the frame 300. The lid 104 may be integrally connected to the frame 300; they may be molded as one piece. The lid 104 may include a first portion 400 and a second portion 500. The first portion 400 may be non-integrally connected to the second portion 500. The first portion 400 may be in the form of a dial, and the second portion 500 may be in the form of a cover.

The frame 300 may include an opening 310 that is substantially aligned with the opening 240 of the container body 200 when the closure system 110 is connected to the container body 200. In the closed position, the lid 104 may cover the opening 310 of the frame 300, thereby preventing access to the storage space 210 of the container body 200. In the open position, the lid 104 is removed, for example by swinging on one or more hinges 120, from the opening 310 of the frame 300, thereby allowing access to the storage space 210.

The closure system 110 that may include biasing means 130, such as a spring or an elastic insert, the urges the at least a portion of the closure system 110, e.g., the lid 104, to the open position, particularly when a locking system 140 is disengaged. The biasing means 130 may be an elastic insert 132, which may comprise a thermoplastic elastomer. The insert 132 may be co-molded with, or molded in a second shot to, the frame 300 and/or lid 104.

The closure system 110 may comprise a locking system 140. When the locking system 140 is engaged, the closure system 110 is retained in the closed position. When the locking system 140 is not engaged (e.g., moved from an engaged position to a disengaged position), the closure system 110 can be moved from the closed position to the open position.

The closure system 110 may require a rotation action in order to disengage the locking system 140. The first portion 400 (e.g., a dial) may be rotated relative to the second portion 500 (e.g., a cover). The rotation action may disengage a latch from a catch. The latch may be located on the lid 104, for example on the first portion 400; the catch may be located on the frame 300. The catch may instead be located on the container body 200.

The closure system 100 may require a pressing action in order to disengage the locking system 140. The locking system 140 may comprise a push pad 410, preferably at least two push pads 410, 411, that must be pressed in order to disengage the locking system 140. The push pads 410, 411 may need to be pressed radially inward in order to disengage the locking system 140. Pressing on the pads 410, 411 may disengage the locking system 140 directly, or it may enable a second action, for example rotation, that will disengage the locking system 140.

The locking system 140 may require both a pressing action and a rotation action in order to disengage the locking system 140. For example, pressing on push pads 410, 411, for example radially inward, may enable them to clear a notch or other blocking structure of the closure system that would otherwise block rotation; however, once moved clear of the notch or blocking structure, the locking system 140 may be rotated, which may disengage a latch from a catch, thereby allowing at least a portion of the closure system 110, e.g., the lid 104, to be moved to the open position.

Figure 7:
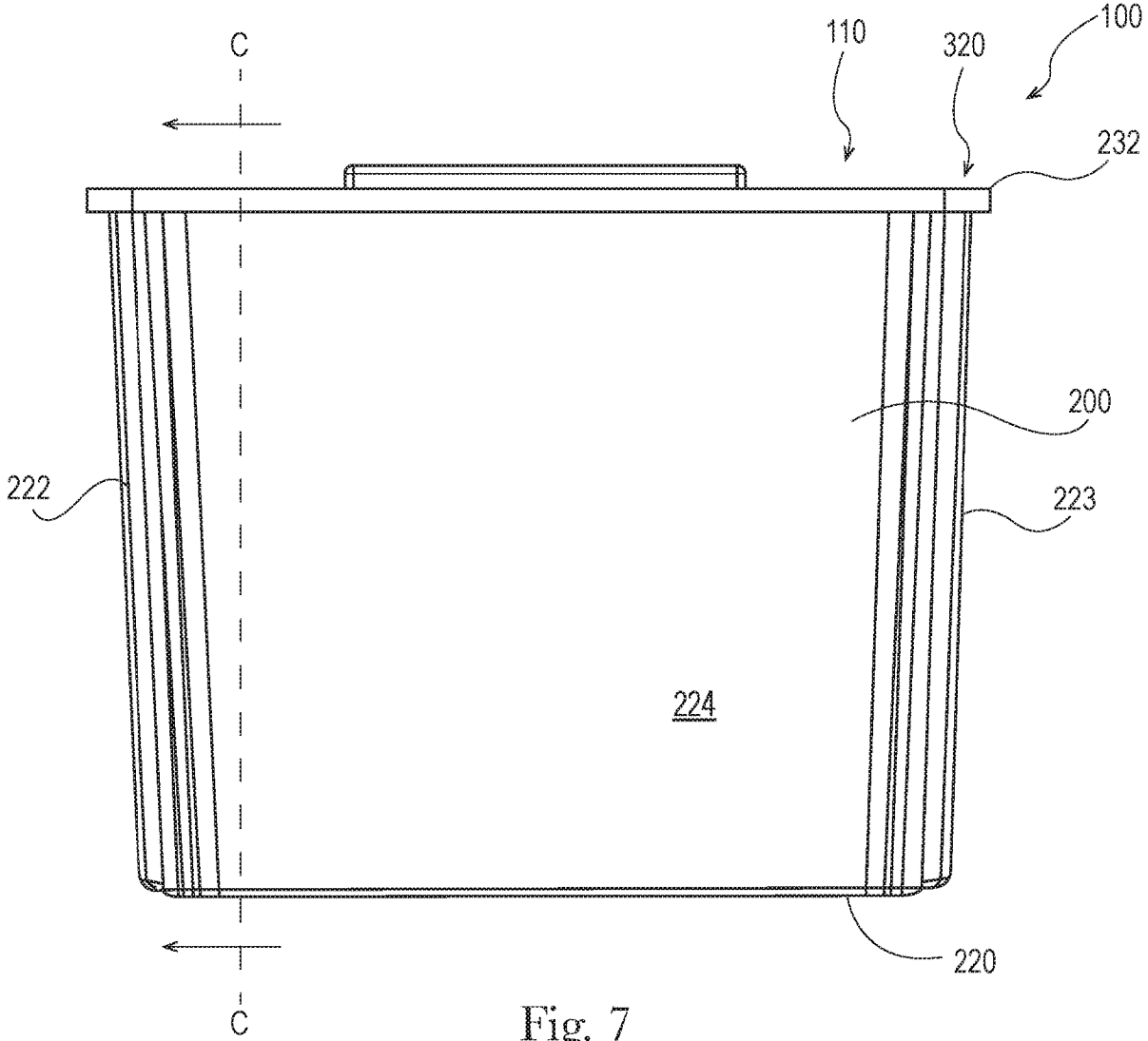
FIG. 7 shows a front view of a container system according to the present disclosure.

FIG. 7 shows a front view of an exemplary container system 100 of the present disclosure. The closure system 110 is connected to the container body 200 and is in the closed position. As shown in FIG. 7, the closure system 110 does not extend past the rim 232 of the container body 200 and/or does not cover the upper surface 275 of the rim 232. In effect, compared to the rim 232 of the container body 200, the closure system 110 is positioned radially inward. Although portions of the closure system 110 may extend to a plane that is axially above a plane formed by the rim 232, the outer, terminal edge 320 of the closure system 110 is not easily accessible and is nested within the neck 230 and/or rim 232 of the container 200.

Figure 8:
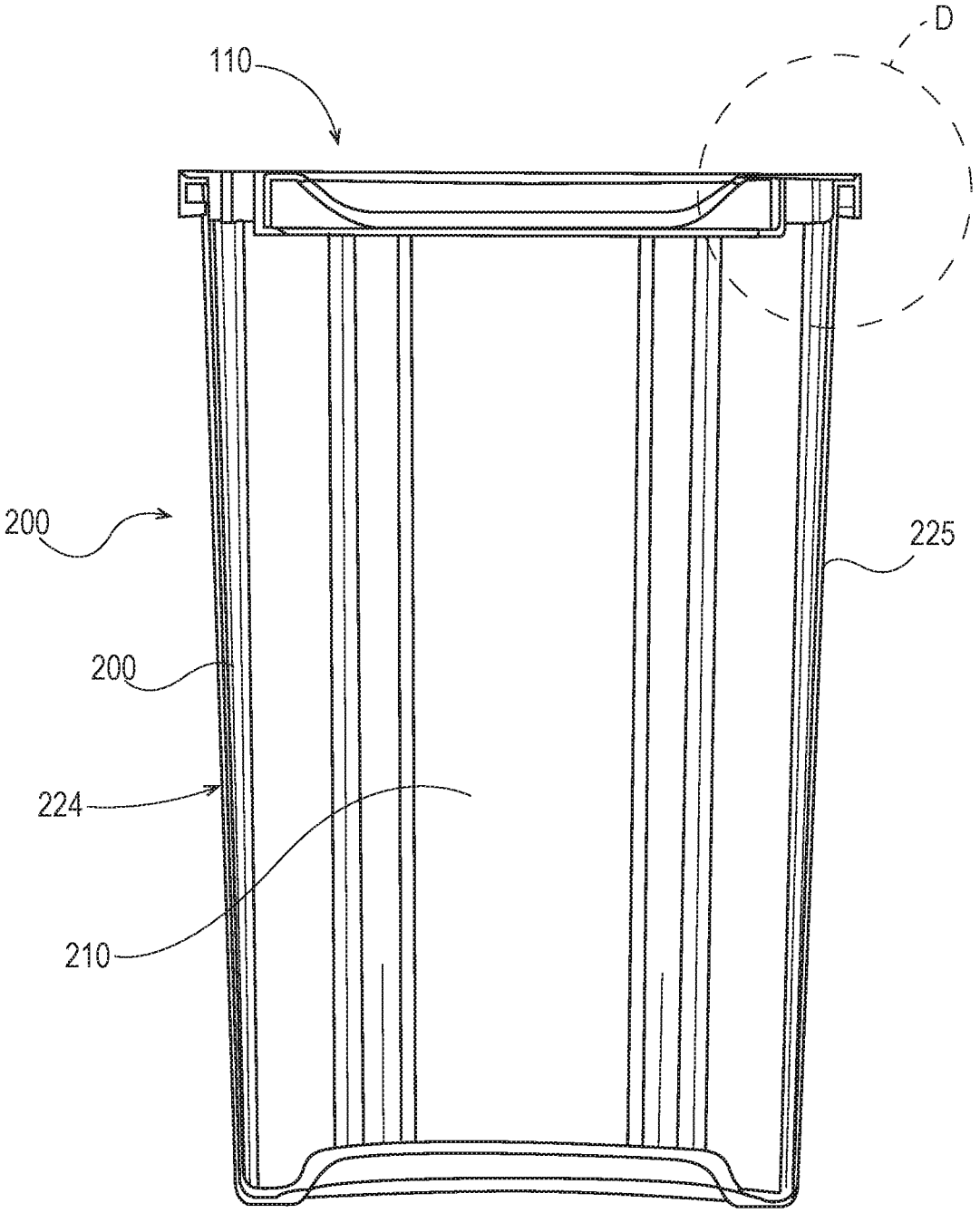
FIG. 8 shows a portion of a side cross-sectional view taken along line C-C of FIG. 7.

FIG. 8 shows a portion of the cross-sectional view of the container system 100 of FIG. 7, taken at line C-C and viewed as shown by the arrows. The closure system 110, e.g, the frame 300, may include support ribs 323 that extend into the storage space 210 when the closure system 110 is connected to the container body 200.

Figure 9:
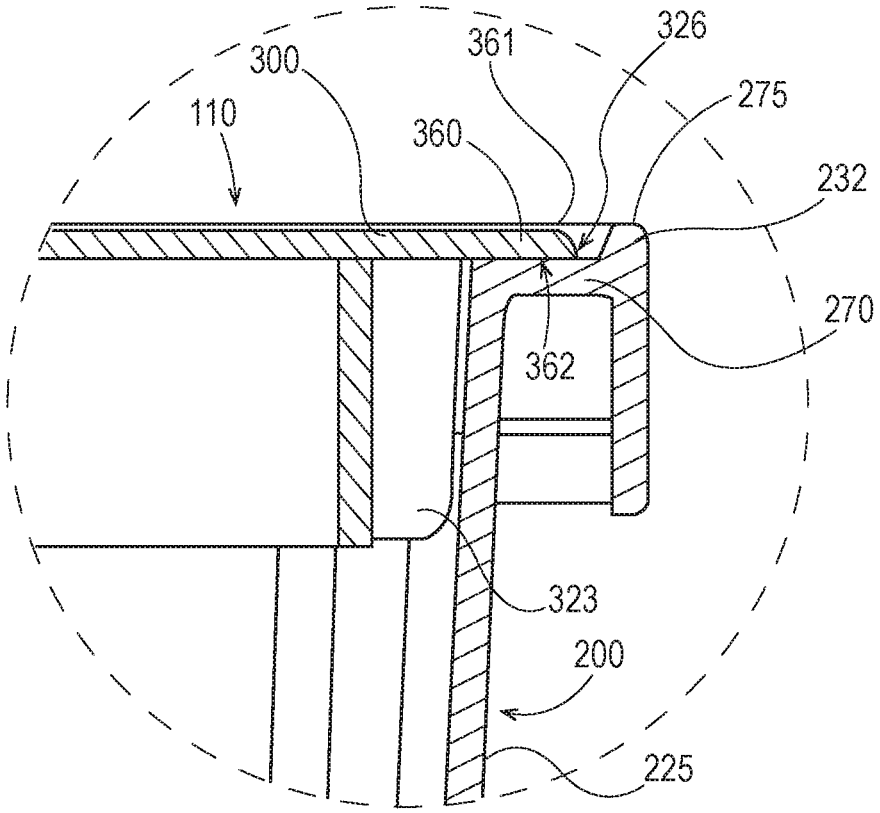
FIG. 9 shows a close-up view of the portion of FIG. 8 highlighted by circle D.

FIG. 9 shows a close-up view of the section highlighted in circle D in FIG. 8. As shown in FIG. 9, the closure system 100 does not cover the upper surface 275 of the rim 232 of the container body 200. More specifically, the outer edge 326 of the closure system 110, which may be part of the frame 300, is adjacent to the inner surface 276 of the rim 232. However, the outer edge 326 does not extend past the rim 232 or cover the upper surface 275 of the rim 232. Thus, the outer edge 326 of the closure system 110 is not easily accessible, and the closure system 110 cannot easily be pried off.

As shown in FIG. 9, the outer edge 326 of the closure system 110 is located at a distal end 361 of a flange 360 of the closure system 110. The flange 360 may have a bottom surface 362 that faces the ledge 270 of the container body 200 when the closure system 110 is connected to the container body 200. The bottom surface 362 may rest upon the ledge 270.

The flange 360 may have an upper surface 363. The upper surface 363 of the flange 360, particularly near the distal end 361 of the flange 360, may form a plane that is not axially higher than a plane formed by the upper surface 275 of the rim 232. However, it is recognized that other parts of the closure system 110 may rise axially above the plane formed by the rim. That being said, because a terminal or outer edge 326 of the closure system 110 is not easily accessible, securing a solid grip or leverage adequate to pull or pry the closure system 110 off of the container body 200 is difficult.

The container system 100 of the present disclosure may include a container body 200 and a closure system 110 that is connectable to the container body 200, the container body 200 having a storage space 210, an opening 240 that provides access to the storage space 210, and a neck 230 and/or rim 232 that substantially encircles the opening 240, the closure system 110 being sized and configured to the cover the opening 24 when the closure system 110 is in a closed position, thereby preventing access to the storage space 210, the closure system further comprising a locking system 140 such as a latch and catch, where when the locking system 140 is engaged, the closure system 110 is retained in the closed position, and where when the locking system 140 is not engaged, the closure system 140 can be moved from the closed position to an open position, where when the closure system 110 is in the closed position, an outer or terminal edge 326 of the closure system 110 that is spaced away from the center of the closure system 110 is nested in the neck 230 and/or rim 232 of the container body 200 (for example, the outer or terminal edge 326 is spaced radially inward to the neck 230 and/or rim 232); the container system 100 may include unitized dose articles 600 in the storage space 210.

Contents

The container system 110 may further comprise any suitable material or composition in the storage space. Typical materials and compositions include, but are not limited to, fabric care treatments, hard surface cleaners, soaps, shampoos, conditioning agents, pesticides, paint, solvents, industrial chemicals, industrial hardware (e.g., nails, screws, etc.), medicines, pills, food, and the like. The material may be water-sensitive material, meaning that the material has a tendency to dissolve or degrade when exposed to liquid water or water vapor. The material may be a consumer product, preferably a household care product, preferably a cleaning composition, more preferably a cleaning composition in the form of a unitized dose article.

Non-limiting examples of useful compositions include light duty and heavy duty liquid detergent compositions, hard surface cleaning compositions (such as dish care compositions, including compositions intended for use in an automatic dishwashing machine), detergent gels commonly used for laundry, bleach and laundry additives, shampoos, body washes, and other personal care compositions. Compositions may take the form of a liquid, gel, solid, a unitized dose article, or mixtures thereof. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

In some aspects, the compositions may comprise one or more of the following non-limiting list of ingredients: opacifier; antioxidant; fabric care benefit agent; detersive enzyme; deposition aid; rheology modifier; builder; bleaching agent; bleach precursor; bleach catalyst; chelant; perfume; whitening agent; pearlescent agent; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents; corrosion inhibitors and/or anti-tarnish agents; rinse aids. Additionally or alternatively, the compositions may comprise surfactants and/or solvent systems.

The composition may be a flowable composition that can be scooped, such as a free-flowing granular or powdered composition. In such cases, the container system 100 may further comprise a scoop adapted to fit into the container system 100 and to scoop the scoopable composition.

Figure 10:
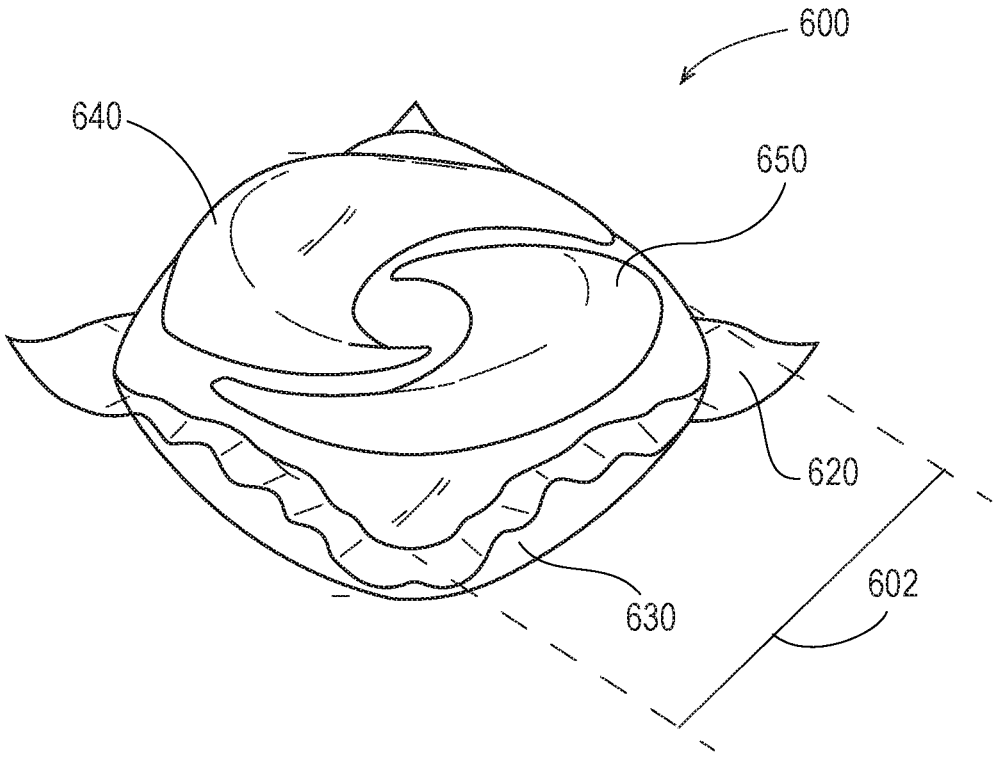
FIG. 10 shows a unitized dose article according to the present disclosure.

The container systems 100 described herein are particularly useful for containing compositions in the form of an article 600. FIG. 10 shows an example of a unitized dose article 600. The article 600 may be suitable to be grasped by an adult human hand. Such articles 600 may have an article width 602 of from about 10 mm to about 100 mm, or from about 20 mm to about 70 mm, or from about 35 mm to about 55 mm, or from about 40 mm to about 50 mm If the article 600 is rectangular in shape, the article width 602 is measured as the greatest distance between two parallel sides. When an article 600 has a variable width, the article width 602 is the average of such widths. Such articles 600 may have a height, of from about 10 mm to about 100 mm, or from about 15 mm to about 70 mm, or from about 20 mm to about 50 mm, or from about 25 mm to about 35 mm When an article 600 has a variable height, the article height is measured at the maximum height of the article.

Typically, the container systems 100 described herein are useful for containing articles 600 of unitized doses of a composition (e.g., in counts of 15, 25, 50, 66, 77, etc.), typically of a cleaning composition, more typically of a laundry detergent or hard surface treatment composition. The unitized dose article 600 may be a pouch. The pouch may be formed from a water-soluble film 620, such as a polyvinyl alcohol film, including those available from MonoSol, LLC. The film 620 may encapsulate the composition in a compartment. The pouch may comprise a single compartment, or it or may comprise multiple compartments 630, 640, 650.

The pouch may contain various compositions, which may be of varying colors that may be seen from outside of the pouch. A multi-compartment pouch may contain the same or different compositions in each separate compartment. The compartments may be side-by-side or superposed, for example one or two smaller compartments 640, 650 superposed on one larger compartment 630. This multi-compartment feature may be utilized to keep compositions containing incompatible ingredients (e.g., bleach and enzymes) physically separated or partitioned from each other. It is believed that such partitioning may expand the useful life and/or decrease physical instability of such ingredients.

The compositions of the unitized dose articles 600 typically have low levels of water. In some aspects, the compositions 600 comprise less than about 50%, or less than about 30%, or less than abou 20%, or less than about 15%, or less than about 12%, or less than about 10%, or less than about 8%, or less than 5%, or less than 2% water by weight of the composition 600. In some aspects, the composition 600 comprises from about 0.1% to about 20%, or from about 1% to about 12%, or from about 5% to about 10% water by weight of the composition 600.

Methods

The present disclosure relates to methods of assembling a container system 100, such as any of the container systems described herein. For example, the method may include the step of providing a container body 200 having a storage space 210 and an opening 240 that provides access to the storage space 210. The container body 200 may further have a rim 232 that substantially encircles the opening 240. The rim 232 may have an upper surface. Additional features of suitable container bodies 200 are described above.

The method may further include the step of providing a closure system 110 that is connectable to the container body 200. The closure system 110 may be sized and configured to cover the opening 240 when the closure system 110 is in a closed position, preventing access to the storage space 210. The closure system 110 may include a locking system 140. When the locking system 140 is engaged, the closure system 110 is retained in the closed state. When the locking system 140 is not engaged, the closure system 110 can be moved from the closed position to an open position.

The method may further include the step of connecting the closure system 110 and the container body 200 so that when the closure system 110 is connected to the container body 200 and is in the closed position, the closure system 100 does not cover the upper surface 275 of the rim 232.

The method may further include the step of providing contents to the storage space 210 of the container body 200. Typical materials and compositions include, but are not limited to, fabric care treatments, hard surface cleaners, soaps, shampoos, conditioning agents, pesticides, paint, solvents, industrial chemicals, industrial hardware (e.g., nails, screws, etc.), medicines, pills, food, and the like. The material may be water-sensitive material, meaning that the material has a tendency to dissolve or degrade when exposed to liquid water or water vapor. The material may be a consumer product, preferably a household care product, preferably a cleaning composition, more preferably a cleaning composition in the form of a unitized dose article 600, as described above.

The step of providing contents to the storage space 210 may occur before the closure system 110 is connected to the container body 200; this may be preferred as the opening 240 of the container body is likely larger than the opening 310 of the frame 300 of the container system 110.

The step of providing contents to the storage space 210 may occur after the closure system 110 is connected to the container body 200; this may be preferred when, for example, the body 200 and closure system 110 are assembled (i.e., by a packaging manufacturer) at a different time and/or location than the filling process. In such cases, the closure system 110 is in the open position when filling occurs. The closure system 110 may be moved to the closed position and the locking system 140 may be engaged when the filling step is completed.

The present disclosure further relates to a method of accessing contents of a container system 100. A container system 100 according to the present disclosure may be provided. The locking system 140 may be disengaged and the closure system 110 may be moved from the closed position to the open position. Contents, such as a consumer product, may be removed from the storage space 210 of the container body 200. The closure system 110 may be moved from the open position to the closed position. The closure system 110 may provide a signal, such as an audible signal like a click, to let the user know that the closure system 100 has been properly closed. The consumer product may be a household care product, preferably a cleaning composition, more preferably a cleaning composition in the form of a unitized dose article 600. The product may be provided to machine suitable for the products intended use, such as an automatic dish washing machine or an automatic laundry machine.

Combinations

Specifically contemplated combinations of the disclosure are herein described in the following lettered paragraphs. These combinations are intended to be illustrative in nature and are not intended to be limiting.

A. A container system comprising: a container body having a storage space and an opening that provides access to the storage space, the container body further having a rim that substantially encircles the opening, the rim having an upper surface, a closure system that is connectable to the container body and is sized and configured to cover the opening when the closure system is in a closed position, preventing access to the storage space, the closure system comprising a locking system, where when the locking system is engaged, the closure system is retained in the closed position, and where when the locking system is not engaged, the closure system can be moved from the closed position to an open position, where when the closure system is connected to the container body and is in the closed position, the closure system does not cover the upper surface of the rim.

B. A container system according to paragraph A, wherein the container body comprises a neck that terminates in the rim.

C. A container system according to any of paragraphs A-B, wherein the rim includes an inner surface facing radially inward.

D. A container system according to any of paragraphs A-C, wherein the closure system is located radially inward to the inner surface of the rim when connected to the container body.

E. A container system according to any of paragraphs A-C, wherein the closure system has an outer edge, where the outer edge is adjacent the inner surface of the rim when the closure system is connected to the container body.

F. A container system according to any of paragraphs A-E, wherein the closure system moves about a hinge when moving from the closed position to the open position.

G. A container system according to any of paragraphs A-F, wherein the closure system comprises a frame and a lid.

H. A container system according to paragraph G, wherein the lid is hingedly connected to the frame.

I. A container system according any of paragraphs A-H, wherein the locking system comprises a button, a latch, a thread system, a snap bead, or a combination thereof.

J. A container system according to paragraphs I, wherein the locking system comprises a push pad, preferably at least two push pads, that must be pressed in order to disengage the locking system.

K. A container system according to paragraph J, wherein the push pad, preferably the at least two push pads, must be pressed radially inward.

L. A container system according to any of paragraphs A-K, wherein the closure system comprises a first portion and a second portion that is non-integrally connected to the first portion.

M. A container system according to paragraphs L, wherein the first portion comprises a push pad that must be pressed in order to disengage the locking system.

N. A container system according to any of paragraphs A-M, wherein the closure system requires a rotation action in order to disengage the locking system.

O. A container system according to any of paragraphs A-N, wherein a snap-on connection system selected from a rib, a bead, a tab, a slot, or combinations thereof connects the container body and the closure system.

P. A container system according to any of paragraphs A-O, wherein the container system further comprises a consumer product in the storage space, preferably a household care product, preferably a cleaning composition, more preferably a cleaning composition in the form of a unitized dose article.

Q. A method of assembling a container system, the method comprising the steps of: providing a container body having a storage space and an opening that provides access to a storage space, the container body further having a rim that substantially encircles the opening, the rim having an upper surface, providing a closure system that is connectable to the container body and is sized and configured to cover the opening when the closure system is in a closed position, preventing access to the storage space, the closure system comprising a locking system, where when the locking system is engaged, the closure system is retained in the closed state, and where when the locking system is not engaged, the closure system can be moved from the closed position to an open position, connecting the closure system and the container body so that when the closure system is connected to the container body and is in the closed position, the closure system does not cover the upper surface of the rim.

R. A method according to paragraph Q, where the method further comprises the step of providing contents to the storage space of the container.

S. A method according to any of paragraphs Q-R, wherein the step of providing the contents to the storage space of the container occurs before the step of connecting the closure system and the container body.

T. A method according to any of paragraphs Q-S, wherein the contents comprise consumer product, preferably a household care product, preferably a cleaning composition, more preferably a cleaning composition in the form of a unitized dose article.

U. A container system according to any preceding paragraph, where the container system includes a container body and a closure system that is connectable to the container body, the container body having a storage space, an opening that provides access to the storage space, and a neck that substantially encircles the opening; the closure system being sized and configured to the cover the opening when the closure system is in a closed position, thereby preventing access to the storage space, the closure system further including a locking system, where when the locking system is engaged, the closure system is retained in the closed position, and where when the locking system is not engaged, the closure system can be moved from the closed position to an open position, where when the closure system is in the closed position, an outer or terminal edge of the closure system that is spaced away from the center of the closure system is nested in the neck of the container body; the container system further comprising unitized dose articles in the storage space.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising:

a container body having a storage space and an opening that provides access to the storage space, the container body further having a rim that substantially encircles the opening, the rim having an upper surface, a closure system that is connectable to the container body and is sized and configured to cover the opening when the closure system is in a closed position, preventing access to the storage space, the closure system comprising a locking system, where when the locking system is engaged, the closure system is retained in the closed position, and where when the locking system is not engaged, the closure system can be moved from the closed position to an open position, the closure system further comprising a frame and a lid, wherein the lid is hingedly connected to the frame, and where when the closure system is connected to the container body and is in the closed position, the closure system does not cover the upper surface of the rim.

2. A container system according to claim 1, wherein the container body comprises a neck that terminates in the rim.

3. A container system according to claim 1, wherein the rim includes an inner surface facing radially inward.

4. A container system according to claim 3, wherein the closure system is located radially inward to the inner surface of the rim when connected to the container body.

5. A container system according to claim 3, wherein the closure system has an outer edge, where the outer edge is adjacent the inner surface of the rim when the closure system is connected to the container body.

6. A container system according to claim 1, wherein the closure system moves about a hinge when moving from the closed position to the open position.

7. A container system according to claim 1, wherein the locking system comprises a button, a latch, a thread system, a snap bead, or a combination thereof.

8. A container system according to claim 7, wherein the locking system comprises a push pad, that must be pressed in order to disengage the locking system.

9. A container system according to claim 8, wherein the push pad must be pressed radially inward.

10. A container system according to claim 1, wherein the closure system comprises a first portion and a second portion that is non-integrally connected to the first portion.

11. A container system according to claim 10, wherein the first portion comprises a push pad that must be pressed in order to disengage the locking system.

12. A container system according to claim 1, wherein the closure system requires a rotation action in order to disengage the locking system.

13. A container system according to claim 1, wherein a snap-on connection system selected from a rib, a bead, a tab, a slot, or combinations thereof connects the container body and the closure system.

14. A container system according to claim 1, wherein the container system further comprises a consumer product in the storage space.

15. A method of assembling a container system, the method comprising the steps of:

providing a container body having a storage space and an opening that provides access to the storage space, the container body further having a rim that substantially encircles the opening, the rim having an upper surface, providing a closure system that is connectable to the container body and is sized and configured to cover the opening when the closure system is in a closed position, preventing access to the storage space, the closure system comprising a locking system, where when the locking system is engaged, the closure system is retained in the closed state, and where when the locking system is not engaged, the closure system can be moved from the closed position to an open position, the closure system further comprising a frame and a lid, wherein the lid is hingedly connected to the frame, and connecting the closure system and the container body so that when the closure system is connected to the container body and is in the closed position, the closure system does not cover the upper surface of the rim.

16. A method according to claim 15, where the method further comprises the step of providing contents to the storage space of the container, wherein the contents comprise a household care product.

17. A method according to claim 16, wherein the step of providing the contents to the storage space of the container occurs before the step of connecting the closure system and the container body.

18. A container system comprising a container body and a closure system that is connectable to the container body, the container body having a storage space, an opening that provides access to the storage space, and a neck that substantially encircles the opening;

the closure system being sized and configured to the cover the opening when the closure system is in a closed position, thereby preventing access to the storage space, the closure system further comprising a locking system, where when the locking system is engaged, the closure system is retained in the closed position, and where when the locking system is not engaged, the closure system can be moved from the closed position to an open position, the closure system further comprising a frame and a lid, wherein the lid is hingedly connected to the frame, where when the closure system is in the closed position, an outer or terminal edge of the closure system that is spaced away from the center of the closure system is nested in the neck of the container body;

the container system further comprising unitized dose articles in the storage space.

* * * * *